United States Patent [19]

Shelby

[11] 3,957,043

[45] May 18, 1976

[54] RE-BREATHING APPARATUS

[76] Inventor: William Barney Shelby, 5 Rockbourne St., Elizabeth South, South Australia, Australia 5113

[22] Filed: Aug. 21, 1974

[21] Appl. No.: 499,207

[30] Foreign Application Priority Data

Aug. 22, 1973 Australia ..... 4578/73

[52] U.S. Cl. ..... 128/142 G; 128/191 R; 128/204; 137/88

[51] Int. Cl.[2] ..... A62B 7/02

[58] Field of Search ..... 128/142–142.4, 128/191, 188, 203, DIG. 17, 145.8, 204, DIG. 29; 137/88

[56] References Cited

UNITED STATES PATENTS

| | | | |
|---|---|---|---|
| 3,556,098 | 1/1971 | Kanwisher | 128/142 |
| 3,593,735 | 7/1971 | Reiher | 128/142.2 |
| 3,675,649 | 7/1972 | Basham | 128/DIG. 17 |
| 3,794,059 | 2/1974 | Burt, Jr. | 128/142.2 |
| 3,805,590 | 4/1974 | Ringwall et al. | 128/142 |

*Primary Examiner*—Robert W. Michell
*Assistant Examiner*—Henry J. Recla
*Attorney, Agent, or Firm*—Jay L. Chaskin

[57] ABSTRACT

This invention relates to a diver's re-breathing apparatus of a closed circuit type. The gas circuit is provided with a solenoid valve coupled to an oxygen cylinder and arranged to be energised to introduce oxygen into the breathable atmosphere when the oxygen content therein drops below a certain proportion.

The electrical circuit comprises a pair of transducers in the gas circuit, one of which is sensitive to oxygen partial pressure and the other sensitive to total pressure, the outputs of the two transducers being amplified and fed into an analogue divider, the output of the divider being responsive to percentage of oxygen in the breathable atmosphere and being effective to energise the solenoid to thereby maintain the oxygen content of the breathable atmosphere within limits of percentage, rather than within limits of partial pressure.

10 Claims, 3 Drawing Figures

RE-BREATHING APPARATUS

This invention relates to a closed circuit re-breathing apparatus intended primarily for the use of a diver, and has for an object the conservation of gases.

A further object of the invention is to provide apparatus which will incorporate valuable safety features.

Although a device according to this invention is intended primarily for the use of a diver, it will be apparent that the invention is also of use in other applications wherein a breathable mixture is required, for example under-water living quarters, decompression chambers, space capsules, incubators, oxygen tents, work in smoke or polluted atmosphere, underwater fire-fighting work, or the like.

BACKGROUND OF THE INVENTION

When deep lung dives are to be undertaken, decompression requirements make it necessary for the diver to remain under the surface of the water for some considerable time. Open circuit breathing is therefore no longer feasible because of cost, and it is necessary for a diver to rebreath atmosphere which has already been breathed, scrubbing the carbon dioxide exhaled by the river with a suitable material (for example barium hydroxide) and replenishing the oxygen as it is required. It is believed that the safest inert gas to be mixed with oxygen is helium, and for deep dives it is necessary that the percentage of oxygen be very much less than under atmospheric conditions. Thus typically it is necessary for the oxygen content of the breathable gas to be about 10% if the depth of the dive is between 250 feet and 600 feet. (The standard procedure is to use air 0–100 feet; from 100–250 feet either 50% helium, 50% air or 20% $O_2$ in helium; from 600 feet to a greater depth the oxygen content is varied in accordance with calculations, but will be less than 10%). If oxygen is used to excess, oxygen poisoning can result, this being a most serious hazard to a diver.

In the U.S. Pat. No. 3,556,098 issued to John W. Kanwisher and Walter A. Starck there was described and claimed an apparatus for use by divers wherein the partial pressure of the oxygen in the breathing gases was sensed and when the partial pressure dropped below a lower limit which was not predetermined for a specific dive, but calculated as a percentage per atmosphere, an electrical circuit was energised to drive a solenoid and to add further oxygen. Equipment produced in accordance with the said Patent Specification has been used with some degree of success, but certain difficulties have been encountered. Owing to the lethal nature of difficulties encountered with diving apparatus it is not clear what the basic problems have been, but it is believed that one of the difficulties encountered is the inability of partial pressure sensing to provide a very smooth transition from one mixture strength to another, (for example, when surface supplied emergency gas needs to be used). Furthermore, the percentage of oxygen in the breathing gases varies widely with differences of pressure encountered under normal diving procedures. It is recognised that there are some circumstances under which the human body can tolerate only gradual changes (not more than 3% per minute), and one of the objects of this invention is to provide means whereby the oxygen is maintained, not to pre-determined partial pressure, but to a pre-determined percentage of the total breathable gas.

Further, to meet the difficulty of a diver transferring from automatic to manually controlled fixed percentage breathable gases, another object of this invention is to provide simple means whereby a diver can control the atmosphere which he breathes, over-riding the automatic control device.

Other prior art includes the United States Specification accompanying the U.S. Pat. No. 3,695,261 issued to Donald R. Emmons, wherein a re-breathing apparatus was described which was useful for scuba diving, and the apparatus incorporated means for breathing into and out of a $CO_2$ scrubber for the removal of $CO_2$, and an oxygen sensor for sensing the partial pressure of oxygen in the atmosphere of the re-breather. It is stated to be not useful for very deep dives, (say exceeding 200 feet) except for very short periods of time, partly because the device described therein does not provide means for breathing inert gases other than nitrogen, and partly because it does not provide means for reducing the percentage of oxygen (by volume) as the diver depth is increased, and oxygen poisoning or nitrogen narcosis can result.

Further prior art known to the applicant includes the specification accompanying U.S. Pat. No. 3,252,458 issued to A. R. Krasberg. In that apparatus however the sensing of oxygen was again the sensing of partial pressure rather than the sensng of percentage.

BRIEF SUMMARY OF THE INVENTION

This invention relates to re-breathing apparatus of a closed circuit type which is useful for underwater use, and which comprises a first gas storage bottle containing air, or helium and oxygen, a second cylinder containing oxygen alone, a gas circuit, and an electrical circuit. The gas circuit is provided with gas flow control valves coupled to the respective cylinders, a breathing bag, a mouth piece, a carbon dioxide scrubber, and a solenoid valve coupled to the oxygen cylinder and arranged to be energised to introduce oxygen into the breathable atmosphere when the oxygen content therein drops below a certain limit. The solenoid is arranged to terminate addition of oxygen when the oxygen content increases above a further limit.

The electrical circuit comprises a pair of transducers in the gas circuit, one of which is sensitive to oxygen partial pressure and the other sensitive to total pressure, the outputs of the two transducers being amplified and fed into an analogue divider, the output of the divider being responsive to percentage of oxygen in the breathable atmosphere and the output of the divider being effective to energise the solenoid through solenoid driving means (which may itself be constituted by amplifiers). The device thereby maintains the oxygen content of the breathable atmosphere within limits of percentage, rather than within limits of partial pressure. These limits are maintained notwithstanding variation of depth of operation by the diver.

BRIEF DESCRIPTION OF THE DRAWINGS

An embodiment of the invention is described hereunder in some detail with reference to and as illustrated in the accompanying drawings in which.

DESCRIPTION OF THE PREFERRED EMBODIMENT

Figure 1:
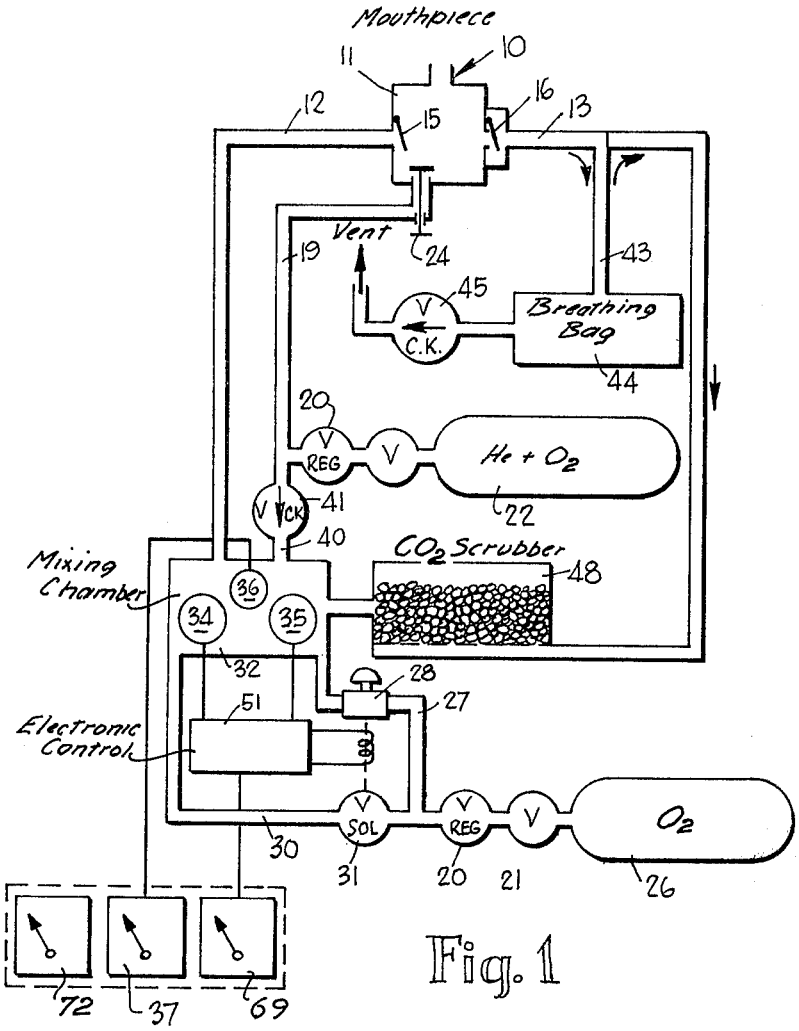
FIG. 1 is a block diagram illustrating the gas circuit.

In the preferred embodiment a mouth piece 10 opens into a small manifold 11, the manifold 11 having a main inlet conduit 12 formed with flexible bellows section rubber hosing, and a similar main outlet conduit 13. The inlet conduit 12 is provided with a one way flap valve 15 and the outlet conduit 13 is provided with a flap valve 16, in this regard the device being in accordance with standard mouth piece design.

However the manifold 11 is further provided with a flexible hose 19 which couples through a regulating valve 20 and a shut off valve 21 to a gas cylinder 22 containing helium, or air and oxygen mixtures under pressure. The hose 19 does not pass directly into the manifold 11, but leads into a push button valve 24, the push button valve 24 constituting one of two over-riding valves enabling a diver to immediately provide himself with a breathable atmosphere (for example of helium and oxygen) in the event that there is malfunction of the equipment, or to manually inflate the breathing bag. This constitutes a very important safety feature in this invention.

A second cylinder designated 26 contains oxygen alone (of sufficient purity for breathing purposes), and this oxygen is coupled to a mixing chamber 32 through a flexible hose 27, the second cylinder 26 like the first cylinder 22, being provided with a shut-off valve also designated 21 and a regulator valve which is also designated 20 as in the first cylinder 22. A second over-ride push button valve 28 is provided, this being the line 27. The push button valve 28 is provided with a spring loaded safety cover (not shown) to prevent accidental oxygen injection, to make it a little less obvious for the diver to operate, although the valve will be readily operable by the diver. The diving procedure is discussed below.

The flexible hose 27 is essentially a branch line, since the breathable atmosphere is continuously monitored and oxygen is added automatically as it is required through a main oxygen line designated 30 by means of a solenoid valve 31. The main oxygen line 30 passes into a mixing chamber designated 32 which contains three sensors. The first sensor is designated 34 and is a total pressure transducer, and the second sensor is an oxygen partial pressure transducer and is sensitive to the partial pressure of oxygen within the breathable atmosphere, while the third self-biasing transducer designated 36 is a separate transducer also being an oxygen partial pressure transducer, and feeds an independent meter 37 which functions as a double check, as discussed below.

The flexible hose 19 may also be regarded as a bypass line to a main helium and oxygen line designated 40, the line 40 passing to the mixing chamber 32 through a check valve 41. The check valve 41 is of known type, either a balanced spool valve or a balanced diaphragm valve, wherein the pressure in the mixing chamber 32 is referenced to the pressure surrounding the apparatus as the diver descends, and when the pressure surrounding the apparatus due to the depth of water increases above the pressure within the mixing chamber 32, the check valve 41 opens to allow the passage of a further quantity of helium and oxygen to pass into the mixing chamber. It should be pointed out that in some instances the check valve 41 can be dispensed with entirely, and the valve 24 only be employed to replenish helium and oxygen to the breathable atmosphere.

As will be seen from FIG. 1 the outlet conduit 13 from the manifold 11 has a branch line 43 extending into a breathing bag 44 formed from flexible material (for example rubber sheet) the breathing bag 44 being provided with a pressure relief valve 45 which opens if the pressure within the breathing bag 44 exceeds that of the surrounding water, that is it opens automatically upon the diver's ascent.

Figure 2:
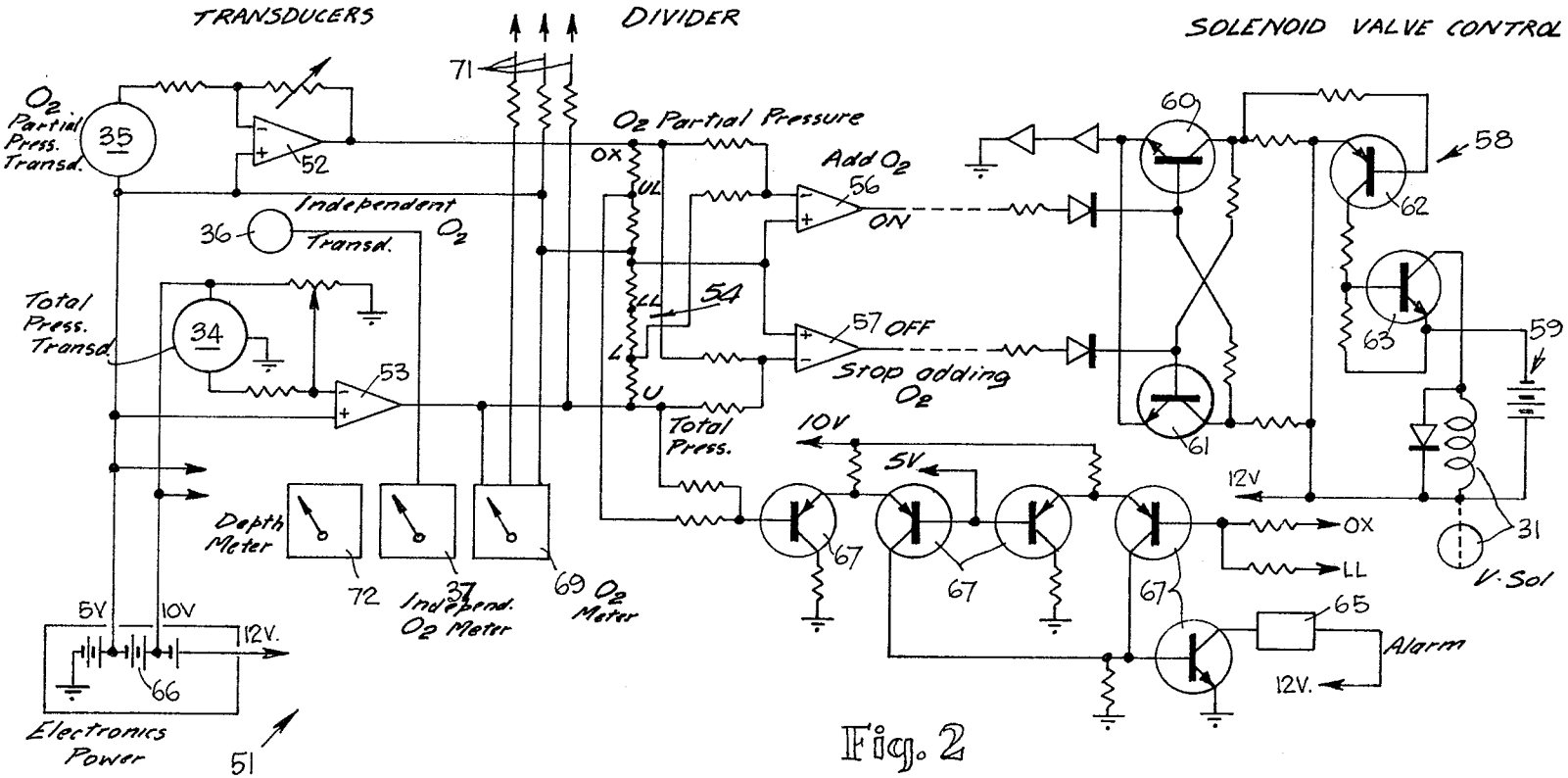
FIG. 2 is a wiring diagram illustrating the electrical circuit.

The outlet conduit 13 extends to a carbon dioxide scrubber designated 48, the carbon dioxide scrubber 48 being a container containing granules of barium hydroxide through which the gas passes before re-entering the mixing chamber. (About four pounds of barium hydroxide is useful for a 6 hour dive at 70°F.) It will thus be seen that the gas generally circulates from the mixing chamber, through the mouth piece, and then outwardly from the mouth piece through the carbon dioxide scrubber and back to the mixing chamber, after the carbon dioxide has been depleted. Referring now to FIG. 2, an electronic control, generally designated 51 comprises the two transducers 34 and 35. It will be appreciated by those skilled in the art that a problem exists in converting the partial pressure of oxygen which is essentially that pressure sensed by the transducer 35 to become a percentage or proportion of oxygen in the breathable mixture so as to avoid the variations of oxygen concentration as a diver varies his depth of dive during a normal working period. This is achieved in this invention by amplifying the output of the partial pressure transducer 35 through an amplifier 52 and amplifying the output of the total pressure transducer 34 through an amplifier 53, and feeding the amplified signals to an analogue divider designated 54. The output of the analogue divider 54 is in turn fed into further amplifiers designated 56 (for the addition of oxygen) and 57 (to effect de-energising of the solenoid 31). The amplifiers 56 and 57 in turn drive a solenoid valve control transistor network which is designated generally 58, and which controls the solenoid 31 in accordance with known art. The solenoid draws its energy from a battery designated 59. The transistors of the network 58 are designated 60, 61, 62 and 63.

In order to provide additional safety to the diver, use is made of an illuminated alarm designated 65. Conveniently this alarm is carried on the diver's facepiece, but is illustrated only in FIG. 2. The alarm 65 draws its power (as do the transducers 34 and 35) from electronics power battery designated 66, it being noted that the batteries 59 and 66 are separated from one another to reduce the risk of battery power failure. The alarm is excited from the analogue divider 54 when the oxygen percentage drops below a safe level or when it rises above its safe level, the alarm being controlled by a network of transistors designated 67. It should be noted that the transistors 67 and the transistors of the network 68 are well known and used in accordance with their normal functions, but the actual selection of elements for the invention is discussed below.

Figure 3:
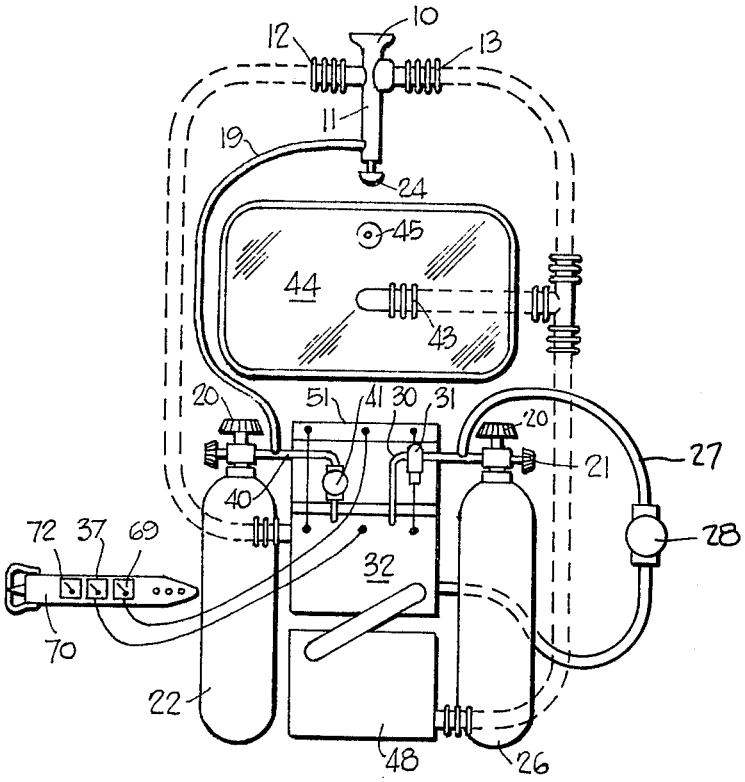
FIG. 3 shows the physical arrangement of the elements of the invention.

In order to provide the diver with an indication of the breathable mixture which he is using, there is provided an oxygen meter 69 carried on a wrist strap 70 (see also FIG. 3) the meter 69 reading the output of the two amplifiers 52 and 53. The outputs of these amplifiers can also be transmitted by lines 71 to a separate controller who is above the surface of the water.

It is also desirable that the diver should be able to immediately read the depth at which he is operating, and this is achieved by a depth meter designated 72, the depth meter 72 merely being a pressure gauge but calibrated in feet (or meters) instead of in pressure. The depth meter 72 is also carried on the wrist strap 70.

The oxygen partial pressure transducer 35 is of the electrolytic type. Various types of oxygen transducers are available, and for example a suitable transducer may be purchased from Bio Marine Industries, 303 West Lancaster Avenue, Devon, Pennsylvania, U.S.A.. Another type is an electrolytic cell containing an electrolyte of potassium hydroxide and electrodes of silver and tin, the total cell reaction being $2Ag + \frac{1}{2}O_2 = Ag_2O$. However there is a transient species which releases two electrons as the tin reacts with the hydroxide radical, and it is the release of these electrons which provides the electrical impulse for driving the amplifier 52. The total pressure transducer 34 may be an LX1440 AO (1000 psi) (National Semi-conductor) transducer, although alternatives may be used. The amplifiers may be selected from any suitable types, one suitable type being the Fairchild $\mu$A7141. The divider may be any one of a number of readily available types or alternatively may be made up by simply joining end to end a series of resistors. However one suitable type is designated LM310 and is also available from National Semi-conductor Corporation, Santa Clara, California U.S.A..

The transistors designated 60, 61 and 67 may be standard transistors, purchased under the designation BC108. The transistors 62 may be BC178, and the transistor 63 may be a 2N3054. However those skilled in the art may have personal preferances for other selections of electronic elements.

It is desirable for a diver to be able to double check the atmosphere which he breathes, and the independent oxygen transducer 36 may be of the same type as the transducer 35, but is coupled to the independent oxygen meter 37 which may be a self-biasing oxygen analyser, for example as that produced by Bio Marine Industries and under Model OA202. The advantage of having a self-biasing oxygen analyser is that the diver is still able to ascertain his oxygen content even though there is a serious malfunction in the electronic circuit. If the lines 71 which extend to the surface are coupled to a Bio Marine oxygen analiser recorder Model 602, there will be provided a continuous record of diving conditions.

The following is the diving procedure with this equipment:

It is assumed that the dive will be a deep dive and therefore that the final oxygen percentage (by volume) to be breathed by the diver is only 10%. The oxygen percentage may be adjusted, for example, for some extremely deep dives the oxygen percent used may be as low as 5%. The helium and oxygen mixture are stored in the breathable ratio of 9 to 1 in the bottle 22, and the diver prepares for immersion by affixing the mouth piece and the face-piece. However the diver must avoid sudden change of atmosphere for reasons described above, and the push button valve 24 is operated to increase the oxygen content from 10% to 20%. The diver is able to ascertain when 20 percent oxygen has been reached by reading the independent oxygen meter 37.

The diver then descends into the water, his descent rate being adjusted so that by the time he has reached a depth of about 100 feet, he will have used up the additional oxygen which has been introduced by the push button operation. He may of course slightly increase his oxygen at any time during descent if the usage of oxygen is faster than the corresponding descent rate. The depth meter 72 will be monitored periodically by the diver alongside the independent oxygen meter 37 to ensure that he is within the allowable range of oxygen and pressure. This range is a wide range, the main requirement being to avoid sudden changes of percentages of gas. After the diver has reached a depth of about 100 feet he is then reliant upon the operation of the two transducers 34 and 35 to maintain his percentage oxygen constant. In the event of a malfunction of the electronics, the diver can separately and independently add oxygen by operation of the oxygen push button valve 28. In the more likely event of sudden failure of gas (for example due to puncturing the breathing bag 44) the diver can have breathable mixture by merely depressing the push button valve 24. Thus it will be seen that the diver can separately override the automatic system at any time.

Various modifications of the illustrated embodiments of the disclosed invention are within the skill of the art. This invention is therefore not limited to the description and drawings and all such modifications are intended to be included within the scope of the appended claims.

The above description has been limited to a single electronics and power unit. However in practice it is desirable that this should be duplicated, and the diver should have freedom to transfer from one system to another so that if there is failure of one system he can still rely upon the automatic monitoring by the other system.

The equipment will be seen to operate without discharge of bubbles, and therefore has certain military advantages.

The equipment is compatible with standard decompression tables which are calculated from constant gas composition, not oxygen partial pressure.

By simple adjustment, the equipment is suitable for maintaining a constant breathable mixture at any depth which man is capable of physiologically sustaining.

Since the equipment already incorporates a total pressure transducer, a signal therefrom, may, if desired be used to energise the depth meter so as to give the diver an accurate reading of depth.

What I claim is:

1. Rebreathing apparatus of the closed circuit type comprising a first gas supply for providing a breathable gas mixture, a second gas supply for providing oxygen alone, a gas circuit, and an electrical circuit, the gas circuit comprising gas flow control valves coupled to the respective gas supplies and a solenoid valve coupled to the oxygen supply and means for interconnecting the solenoid valve to the breathable gas mixture, the electrical circuit comprising a pair of transducers in the gas circuit, one said transducer being sensitive to oxygen partial pressure, the other said transducer being sensitive to total pressure, amplifiers controlled by the output of respective said transducers and arranged to amplify respective said outputs, an analogue divider coupling the outputs of said amplifiers, the output of the divider being indicative of percentage of oxygen in the breathable gas mixture, and solenoid driving means coupled to the output of said analogue divider to the winding of the solenoid valve to energise the solenoid valve upon drop in the percentage of oxygen in the gas circuit so as to open the solenoid valve and thereby introduce oxygen from the oxygen supply to the breathable gas mixture.

2. Rebreathing apparatus according to claim 1 wherein said breathable mixture is a mixture of helium and oxygen.

3. Rebreathing apparatus according to claim 1 wherein said interconnecting conduit means interconnects said first gas supply and a mouth piece, said last-named means comprises a push button valve which is normally closed, but when opened introduces breathable mixture to the mouth piece.

4. Rebreathing apparatus according to claim 1 comprising a mixing chamber, said conduit means interconnecting the mixture chamber to an outlet of a carbon dioxide scrubber, said conduit means further interconnecting the mixing chamber to an outlet of said solenoid valve, and a still further conduit means interconnecting the inlet of said solenoid valve to said second gas supply.

5. Rebreathing apparatus according to claim 4 comprising conduit means connecting the inlet of said solenoid valve to the mixing chamber, and having in its line a push button valve which is normally closed, but when opened introduces oxygen into said mixing chamber.

6. Rebreathing apparatus according to claim 1 wherein said analogue divider comprises a plurality of resistors in series.

7. Rebreathing apparatus according to claim 1 wherein said solenoid driving means comprises a plurality of amplifiers responsive to the output of said analogue divider.

8. Rebreathing apparatus according to claim 1 comprising an electrical meter coupled to the outputs of said transducer controlled amplifiers and calibrated to read percentage of oxygen in the breathable mixture.

9. Rebreathing apparatus according to claim 1 comprising a self-biassing oxygen transducer independent of said electrical circuit and connected to the breathable gas mixture, and an electrical meter coupled to said self-biassing transducer and calibrated to read percentage of oxygen in the breathable mixture.

10. Rebreathing apparatus according to claim 1 wherein said electrical circuit comprises a high-low limit comparator alarm, and an electrical coupling between said alarm and said analogue divider.

* * * * *